US008397477B2

(12) United States Patent
Stephens

(10) Patent No.: US 8,397,477 B2
(45) Date of Patent: Mar. 19, 2013

(54) DALLY POST WITH REMOVABLE CAP AND SLEEVELESS DALLY DEVICE

(76) Inventor: Sandy Hart Stephens, Prosper, TX (US)

( * ) Notice: Subject to any disclaimer, the term of this patent is extended or adjusted under 35 U.S.C. 154(b) by 72 days.

(21) Appl. No.: 12/825,454

(22) Filed: Jun. 29, 2010

(65) Prior Publication Data

US 2011/0067365 A1 Mar. 24, 2011

Related U.S. Application Data

(60) Provisional application No. 61/277,060, filed on Sep. 21, 2009.

(51) Int. Cl.
*B68C 1/02* (2006.01)

(52) U.S. Cl. ..... 54/44.1

(58) Field of Classification Search ..... 54/44.1, 54/44.5, 44.7; *B68C 1/00, 1/08, 1/10*
See application file for complete search history.

(56) References Cited

U.S. PATENT DOCUMENTS

| | | | | | |
|---|---|---|---|---|---|
| 8,820 | A | * | 5/1835 | Bayliss et al. | |
| 15,744 | A | * | 9/1856 | Plant | 54/44.3 |
| 203,626 | A | * | 5/1878 | Lane et al. | 54/44.1 |
| 224,709 | A | * | 2/1880 | Mittendorf | 54/44.1 |
| 261,374 | A | * | 7/1882 | Meanea | 54/44.1 |
| 409,323 | A | * | 8/1889 | Hainkel | 54/44.1 |
| 415,473 | A | * | 11/1889 | Ruwart | 54/44.1 |
| 633,236 | A | * | 9/1899 | Eatman | 54/44.4 |
| 3,388,530 | A | * | 6/1968 | Parker | 54/44.1 |
| 6,062,006 | A | | 5/2000 | Jones | |
| 6,241,271 | B1 | | 6/2001 | Belinky | |
| 6,386,789 | B1 | | 5/2002 | Chausse et al. | |
| 6,775,965 | B2 | * | 8/2004 | Yarbrough | 54/44.1 |
| 6,842,946 | B2 | * | 1/2005 | Hayden | 16/414 |
| 2010/0101194 | A1 | | 4/2010 | McCarthy | |

OTHER PUBLICATIONS

Sagely, R. J. Maker of Custom Horseman's Gear "For a saddle your great grandkids will still be riding", 2006.*

* cited by examiner

*Primary Examiner* — Rob Swiatek
*Assistant Examiner* — Thien Thanh Pham

(57) ABSTRACT

A saddle horn assembly attached to the tree of a saddle in lieu of a conventional saddle horn consisting of a post of rectangular prismatic configuration with a receiving chamber for insertion of a quick release locking pin, a cap with a quick release locking pin attached to and protruding from the bottom thereof that allows the cap to be detached and reattached to the post within seconds, and a dally traction device with a central void of complimentary dimensions to the post, having a hyperboloid external configuration and being symmetrical in both the horizontal and vertical planes such that the device may be rotated and/or inverted about the post so that it may be quickly and easily manipulated to numerous positions to generate even wear about the exterior, thus increasing the longevity of the device and improving the safety and effectiveness of dallying.

4 Claims, 6 Drawing Sheets

DALLY POST WITH REMOVABLE CAP AND SLEEVELESS DALLY DEVICE

CROSS-REFERENCE TO RELATED APPLICATIONS

This application claims priority of provisional application Ser. No. 61/277,060 filed Sep. 21, 2009.

FIELD OF THE INVENTION

The present invention relates to saddle horns that are attached to the swell or pommel of a saddle used for roping for the purpose of providing an element for a roper to take a dally around in order to hold an animal or object taught with a rope. The present invention also relates to those devices positioned about a saddle horn to provide traction for a rope used to take a dally.

BACKGROUND OF THE INVENTION

The present invention relates to those apparatus commonly referred to as saddle horns that are attached to the swell, sometimes referred to as the pommel or fork, of saddles ridden for the purpose of roping an animal or object for competitive or ranching purposes. Conventionally, a saddle horn, which is a single element having a broad top, a slender neck and a broad base, is attached to the pommel of the saddle in front of the rider, thus providing a place for the roper to take a dally—or wrap a lariat rope thereabout without tying a knot—for the purpose of providing traction to the rope, thus allowing the roper to hold the dally while stopping or towing the animal or object at the opposite end of the rope with the horse, animal, or object to which the saddle is mounted.

In competitive roping events such as team roping, the time to complete a competitive run generally ranges from three to fifteen seconds. The amount of time separating the different places awarded in a roping event (first, second, third, etc.) are often separated by tenths or even hundredths of a second. It is therefore critical that the process of taking a dally to stop the animal and thus the timer be as efficient and effective as possible.

A roper attending a roping event may compete in that event as many as 20 times. The amount of time between the completion of one competitor's run and the start of the next competitor's run generally ranges from 20 to 45 seconds. Because a roper generally has multiple runs, and because those runs may be separated by 5 competitors or fewer, the roper may only have a few minutes from one run to the next. Often times this is merely enough time for the roper to ride from the back end of the arena after completing a run to the front end of the arena to commence the next run, leaving little time to make changes to his or her equipment, including adjustments to the saddle horn.

Saddle horns are primarily constructed of metal or alloy. In order to provide sufficient traction to prevent the rope from sliding, and in particular the proper traction required for competitive roping events such as team roping, the prior art involves covering the saddle horn with a material such as rubber or synthetic rubber in one of four ways, only three of which are prevalent in the market:

The most common method of the prior arts is to cover the saddle horn by applying layers of vulcanized rubber or synthetic rubber strips one to two inches wide about the horn. The application process involves placing one piece over the horn, pulling it in one direction, twisting it, pulling it in the opposite direction back over the horn, and repeating this process until the rubber is taught about the horn, and until the rubber is too short to loop over the saddle horn again. The process is repeated with additional strips of rubber tubing until the desired girth about the horn is obtained. This method has the following shortcomings, which are solved with the present invention:

a. To properly cover a bare saddle horn can take as many as seven strips of rubber tubing. The entire process of adequately covering the horn can take a person of normal strength up to ten minutes to complete.

b. It is desirable that the final outer surface of the rubber be as flat as possible to create a smooth consistent surface along the entire vertical plane of the saddle horn. However, the twisting of the tube inherently creates uneven bulges, making it impossible to create a smooth surface of consistent girth. A roper will often have to unwind and reapply the rubber strip in order to get as close to a proper surface as possible. As the repeated process of dallying wears down the strips of rubber and the partially worn older strips are exposed and re-covered with new strips of tubing, the outer surface becomes increasingly irregular in girth and surface texture and rubber protrusions begin to emanate. These anomalies result in less traction and hinder the roper's ability to consistently position the rope at the desired location along the vertical plane of the saddle horn. This decreases the likelihood that the dally will hold, which would result in the escape of the animal and potential disqualification from the competition, and increase the potential of injury to the roper's hand if the rope were to pop off the horn, as the force and action of the rope popping off of the saddle horn are significant and unpredictable.

c. As the wrap wears, protrusions of and grooves within the rubber are created that alter the surface, inhibit traction, and increase the hazard of getting a thumb, finger, or hand caught between the rope and the wrap, thus increasing the potential for injury.

d. As the tubing is generally less than an eighth of an inch thick, a single piece may only last about 10 to 20 dallies, and sometimes only two or three dallies depending on how hard it is to stop the animal, and how well or poorly the strip of tubing is applied. A roper may often use two to five strips of tubing during one practice session or at one roping event.

e. Because most ropers generally start their dally at the base of the saddle horn, close to or even touching the swell of the saddle, and because the majority of the friction is encountered at that spot, the wraps at the base of the horn generally wear out first. This often leaves a groove that presents a circumstance for the rope to get caught between the wraps and the swell of the saddle, thus preventing the roper from releasing the rope immediately upon completion of the run, which is dangerous to the roper, the animal he or she is riding, and the animal that is captured with the rope.

f. It is difficult if not impossible for young or weaker ropers to properly apply a wrap because it takes ample strength to substantially stretch the wrap to obtain several revolutions around the horn for the necessary tautness and desired traction.

A second and less common method of the prior art involves wrapping the horn with a singular strip of rubber, such as the Dally Horn Wrap described by McCarthy in patent application Ser. No. 12/288,985. A solid strip of rubber or similar synthetic material and the method of application about a saddle horn thereof have the following shortcomings, which are solved with the present invention:

a. The solid rubber piece takes approximately five minutes to install and often requires wrapping and re-wrapping to obtain the appropriate fit.

b. Proper application requires the strength of an adult to keep the various layers taught as subsequent layers are wrapped, and to fit the tail piece in place.

c. The device will wear first on the side on which the roper initiates the dally, generally the left side for right handed ropers. Once this side wears out, the entire device is spent, as you cannot unwrap and re-stretch the worn strip without the potential for the strip to break.

A third and even less common method of covering a saddle horn involves forcing a preformed rubber cylinder, such as the Saddle Horn Friction Fitting disclosed by Jones in U.S. Pat. No. 6,062,006, over the saddle horn cap, which has the following shortcomings that are solved by the current invention:

a. The design of the device relies on friction alone to keep the device in place on the horn and not rotate or slip off. Because the internal diameter of the device is smaller than the neck, and thus much smaller than the top of the saddle horn, it is extremely difficult to stretch over the top and position properly on the saddle horn. Forcing the device onto the saddle horn generally requires the strength of two men, even with lubrication. It is not possible for a young roper or a female of average strength to install the device.

c. Once installed, the device wears primarily in the area where the dally is initiated, typically the lower left side. Once this portion of the device is worn beyond use, the device has reached its design life, as it cannot be rotated, removed or inverted without substantial effort, and is typically just cut off. If the device is left on the horn once this section wears, there is the potential for the rope to get caught between the device and the swell of the saddle.

d. Once this device wears out, it must be cut off of the saddle horn with a knife or other device, which is hazardous.

A possible fourth means, that is absent from the market, is the method disclosed by Eugene Parker, Roping Saddle Horn Assembly, U.S. Pat. No. 3,388,530, patented on Jun. 18, 1968, which has the following shortcomings that are solved by the current invention:

a. Parkers embodiment requires at least 6 separate elements: a core, a metallic sleeve, a rubber sleeve, a head, a bolt, and a wrench to remove and/or tighten the bolt.

b. Handling a head, metallic sleeve, rubber sleeve, bolt, and wrench while mounted horseback, especially while riding between runs during a roping competition, is not practical.

c. Accurately positioning the keys of the metallic sleeve into the keyholes of the rubber sleeve, especially while riding horseback, would be cumbersome.

d. The employment of a threaded bolt to secure the head to the core is time consuming, requires a wrench, and would be particularly cumbersome while horseback, and could work loose while riding.

e. Because the friction generating sleeve must be soft enough to impart traction to a rope, the hexagonal cross-section of Parker's inner core requires the addition of the outer sleeve with keys to act as a locking mechanism to prevent the friction generating sleeve from rotating. Such outer sleeve with keys would be costly to manufacture, cumbersome to handle while riding, and would require substantial effort to force the friction sleeve there onto.

Thus, there is a need in the market for a apparatus that can be easily manipulated by a roper of any age and strength while mounted horseback, and while moving, without the necessity of a tool, that remains tight while riding, that offers quick and simple rotation and/or inversion to distribute the wear to increase the effectiveness and longevity of the rubber device, and to allow for easy replacement of the rubber device, said rubber device being properly configured and of the appropriate hardness to not rotate about the horn during use without the necessity of a sleeve is shaped to create a tendency for the rope to be shifted away from the bottom and the top of the device to improve the effectiveness and decrease the hazard of dallying.

BRIEF SUMMARY OF THE INVENTION

The present invention includes a saddle horn assembly consisting of: 1.) a post that is attached to the swell or pommel of a saddle, having a receptor for a locking element, and having a geometric configuration such that the angles between the sides of the post are 90 degrees or less, 2.) a cap assembly comprising a cap and a manually operated quick release locking element such as a push button ball lock pin, and 3.) a traction device having an internal void of complimentary geometric configuration to the post and being hyperbolically shaped with a concave surface, and being symmetrical in the horizontal and vertical planes, with internal void dimensions that are equal to or greater than the dimensions of the post such that said device may be easily fitted over the post and employed for dallying without undesirably rotating about the post, being held rotationally stationary by the friction and leverage between the walls of the post and the internal void of the traction device without the need for a sleeve. This invention offers the following substantial improvements over the prior arts:

a. This three piece saddle horn assembly provides for rapid removal, rotation, inversion, and replacement of the traction device by a roper of virtually any age and strength within the time constraints at a roping event, while riding horseback, without the need for tools or handling of an excessive and cumbersome quantity of elements.

b. The traction device is of optimal symmetrical configuration to allow for rotation and/or inversion about the post to increase longevity, maintain consistent dally surface, and improve the effectiveness and decrease the hazard of dallying.

c. The hyperbolic shape and concave surface of the traction device influences the position of the rope away from the bottom of the device to prevent it from getting caught beneath the device, and away from the top to prevent the rope from popping off the top of the horn.

d. The leverage provided by the 90 degree edges of the post provide sufficient leverage and friction against the void walls of the traction device as to prevent rotation of the traction device without the need for a sleeve between the post and the traction device.

e. Because there is substantial leverage between the surfaces of the post and the traction device, the internal void of the traction device may be slightly larger than the post, which makes it easy to slip the device on and off the post without force or need for lubrication.

BRIEF DESCRIPTION OF THE DRAWINGS

A more complete understanding of the present invention may be had by reference to the following Detailed Description when taken in connection with the accompanying Drawings, wherein.

DETAILED DESCRIPTION OF THE INVENTION

Figure 1:
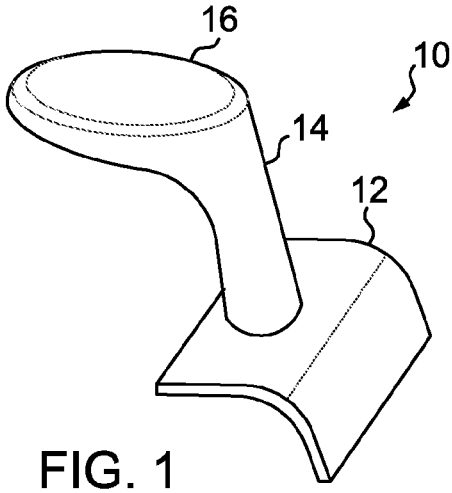
FIG. 1 Prior Art
FIG. 1 is a perspective view of a conventional saddle horn.

Referring now to the drawings, and in particular FIG. 1, there is shown a conventional saddle horn 10, being monolithic in construction, and comprised of a base 12, a neck 14, and a top 16.

Figure 2:
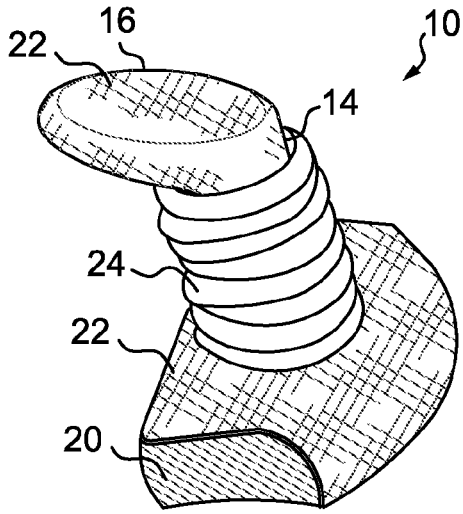
FIG. 2 Prior Art
FIG. 2 is a saddle horn covered with leather and the wrapped with rubber tubing.

Referring now to FIG. 2, there is shown a saddle horn 10, the base of which is attached to the swell 20 of the saddle, which is covered by leather 22, the top 16 is also covered by leather 22, and the neck 14 is wrapped with several strips of rubber tubing 24 with inherently and uneven ridges and grooves.

Figure 3:
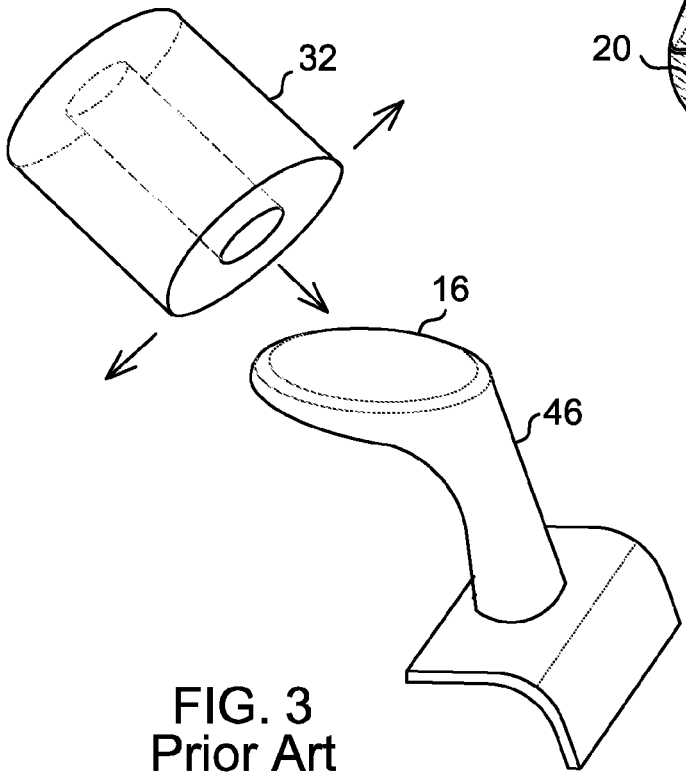
FIG. 3 Prior Art
FIG. 3 is a perspective view of the process of applying the cylindrical device invented by Jones.

Referring now to FIG. 3, there is shown to correct proportional scale a cylindrical saddle horn friction fitting 32 that must generally be stretched at least three times its original diameter to fit over the top 16 and onto the neck 14 of a conventional saddle horn.

Figure 4:
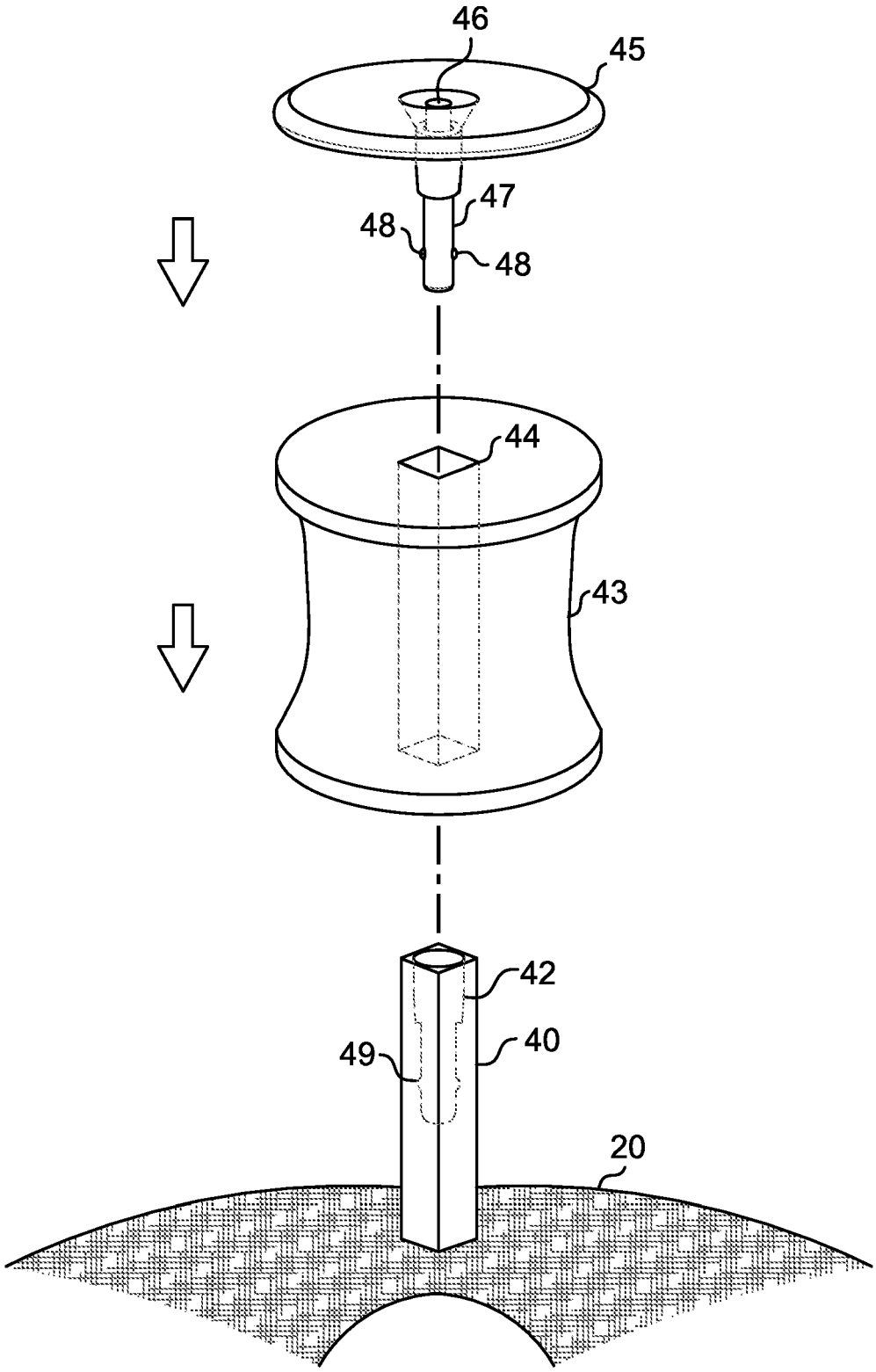
FIG. 4 is a perspective view from the seat of the saddle of one embodiment of the current invention, a dally post of rectangular prismatic configuration attached to the swell of a saddle, with a receiving chamber for a quick release ball and locking pin; a symmetrical and hyperboloid shaped dally device fitted there over; and a cap with an insertion pin protruding from the bottom, the insertion pin housing a spring loaded quick release ball and locking pin mechanism that is activated by the push button on the top of the cap.

Referring now to FIG. 4, there is shown one embodiment of the present invention, a post 40 attached to the swell of a saddle 20, said post having a rectangular prismatic configuration and one embodiment of a receiving chamber 42 for a quick release locking pin, with one embodiment of a dally traction 43, with a rectangular prismatic internal void 44, fitted there over, and a cap 45 with one embodiment of a quick release locking mechanism that includes a push button 46, an insertion pin 47 which contains a free moving internal locking pin, and balls 48 that serve as the locking element. The insertion pin 47 is inserted into the receiving chamber 42, and held into place by the balls 48 that fit within the locking groove 49.

Figure 5:
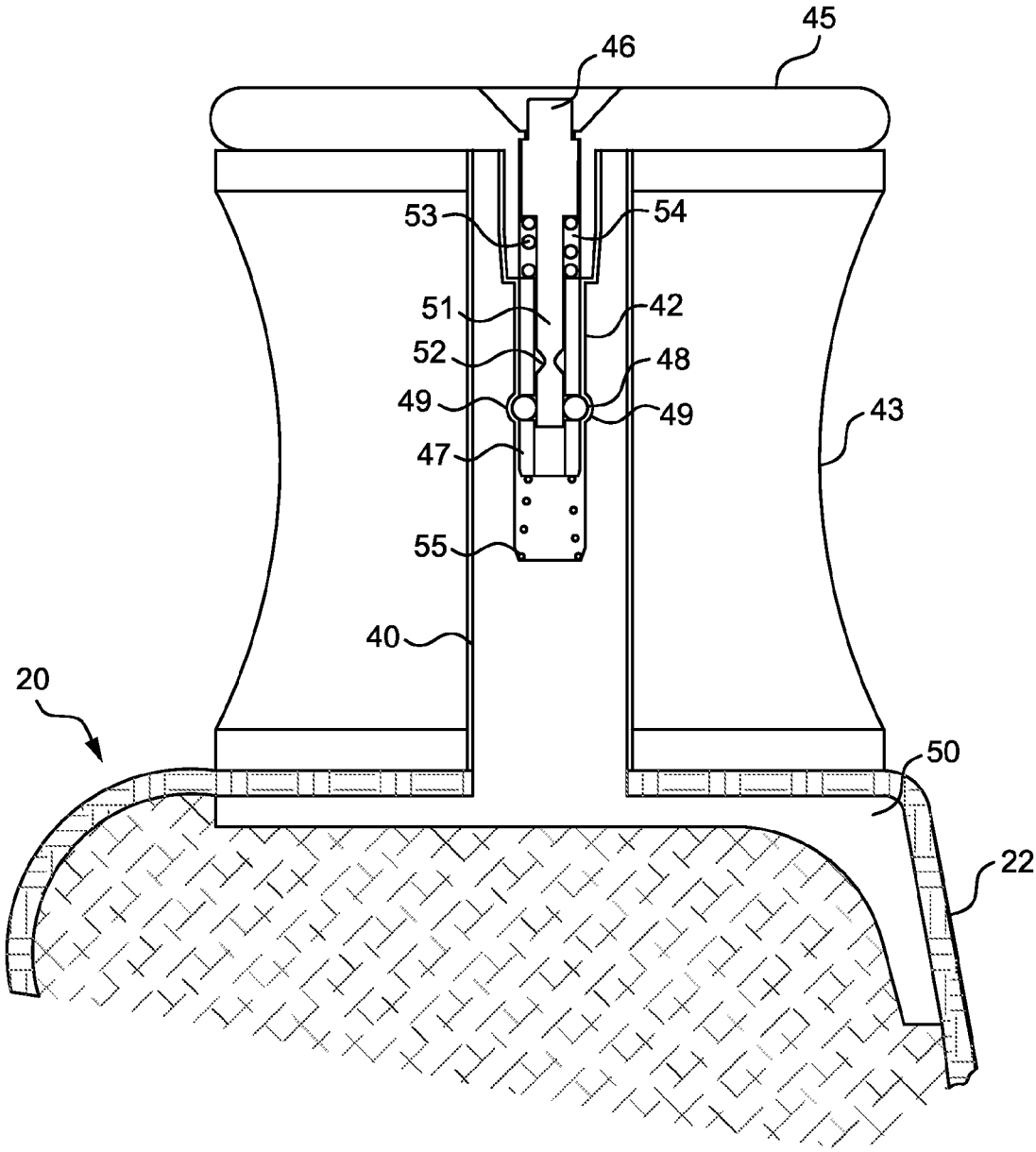
FIG. 5 is a side view cross section of the elements of FIG. 4 assembled together showing the internal elements of the spring loaded quick release ball and pin locking mechanism.

Referring now to FIG. 5, there is shown a side view cross section of the assembled elements of FIG. 4, with the base 50 of the dally post 40 attached to the swell 20 of a saddle and covered by leather 42. The dally device 43 is positioned over and about the post 40, the insertion pin 47, is positioned inside the receiving chamber 42, the balls 48 forced outward by the locking pin 51 are secured in the locking groove 49, the recession grooves 52 of the locking pin 51 are pushed upward by the force of the compression spring 53, which resides in the spring chamber 54, the leverage of the balls 48 in the locking groove 49 thereby holding the cap 45 into place until the push button 46 is pressed and the recession grooves 52 are lowered, thus allowing the balls 48 to recess inward, and the insertion pin 47 to be extracted from the receiving chamber 42, the ease of removal is enhanced by the ejection spring 55 seated at the bottom of the receiving chamber 42 that pushes the unlocked cap upward for easy removal, thus allowing the dally device 43 to be rotated, inverted, or replaced.

Figure 6:
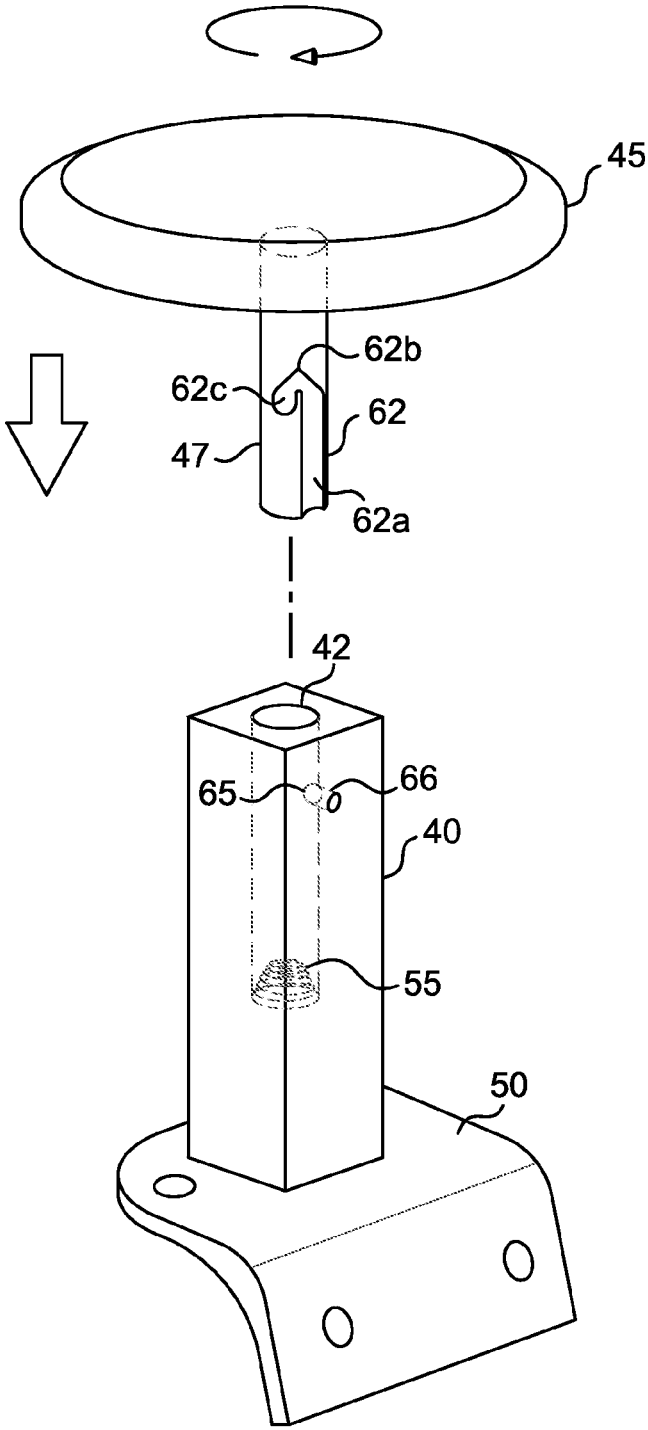
FIG. 6 is a perspective view of the cap and post with another embodiment of a locking mechanism, with the insertion pin having an inverted j-slot that is fitted over a ball that resides in the side of the receiving chamber. Once the cap is fully suppressed within the receiving chamber and the ball is at the apex of the j-slot, the cap is rotated by hand, and a compression spring at the bottom of the receiving chamber forces the cap up and the ball into the shorter section of the j-slot, thus holding the cap in place.
Figure 11:
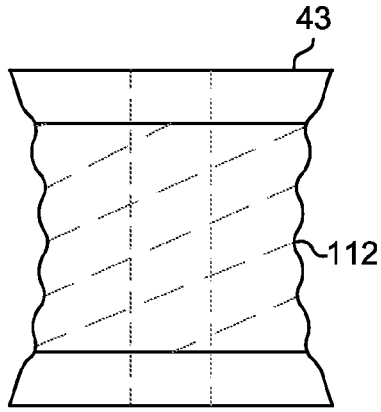

Referring now to FIG. 6, there is a perspective view of a cap 45 and post 40 with a base 50 incorporating a second embodiment of a quick release mechanism, consisting of an insertion pin 47 extruding from the cap 45, with an inverted j-slot 62, said pin 47 is inserted into the receiving chamber 42 of the post 40, which in this embodiment employs a ball 65, secured within a holding chamber 66, that fits into the j-slot 62. A spring 55 is seated at the bottom of receiving chamber 42. As the pin 47 is inserted into the receiving chamber 42, the ball 65 is fitted within the longer, open section 62*a* of the j-slot 62. As the cap 45 is compressed and the ball 65 approaches the apex 62*b* of the j-slot 62, the cap 45 is rotated and released, whereby the spring 55 forces the pin 47 and cap 45 upward to keep the ball locked into the shorter closed section 62*c* of the j-groove 62.

Figure 7:
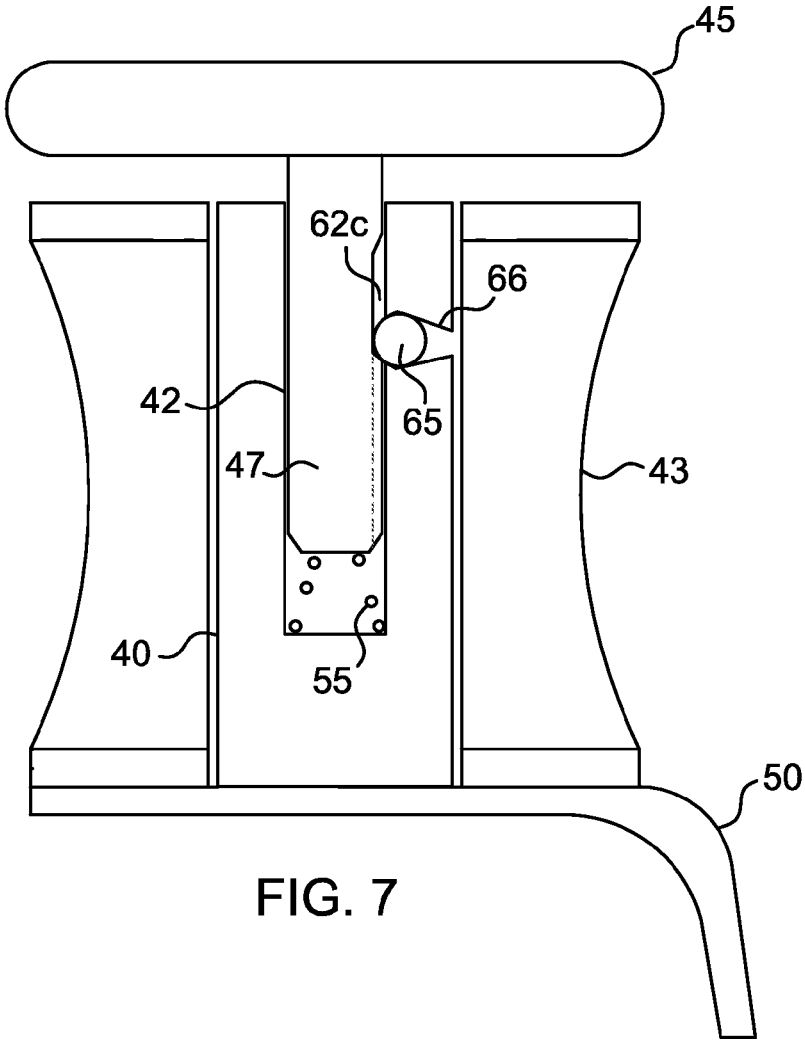
FIG. 7 is a side view cross section of the elements of FIG. 6 assembled showing the internal mechanics of a j-groove and ball locking system.

Referring now to FIG. 7 there is a shown a side view cross section of the assembled cap and post of FIG. 6 with the ball and j-slot locking mechanism, where the pin 47 is positioned in the receiving chamber 42 of the post 40 attached to a base 50. A ball 65 is secured in a holding chamber 66, a portion of the ball protrudes from the holding chamber and is situated in the short section 62*c* of the inverted j-slot, with the pressure of the spring 55 keeping the pin 47 and cap 45 secured, thus securing the dally device 43 about the post.

Figure 8:
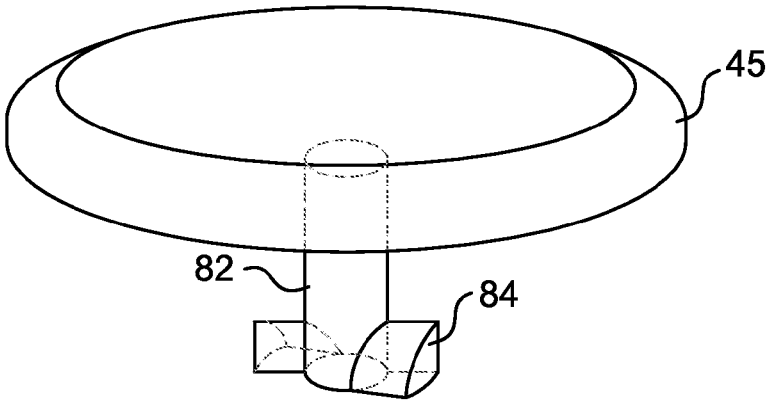
FIG. 8 is a perspective view of the cap with another embodiment of a locking mechanism, a key that protrudes from the bottom of the cap. The key is inserted into a keyway in the post. Once the cap and key is fully suppressed, the cap is rotated by hand, whereby the bits of the key are rotated toward the locking chamber, and forced upward into the locking chamber by a spring in the bottom of the receiving chamber.

Referring now to FIG. 8, there is a perspective view of a cap 45 with another locking embodiment, a key 82 with bits 84.

Figure 9:
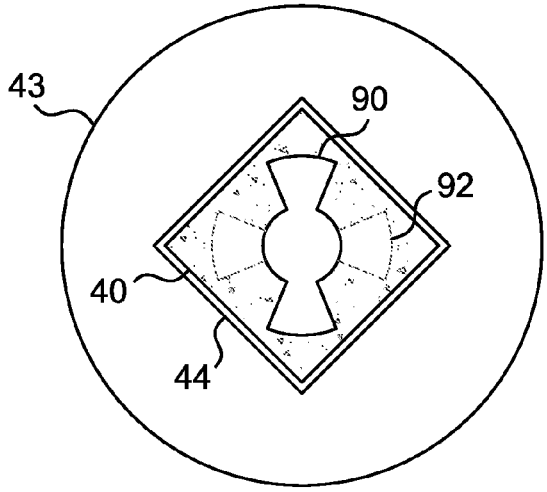
FIG. 9 is a top view of the post designed with a keyway.

Referring now to FIG. 9, there is a top view of a dally post 40, with a keyhole 90, and indicating the relative horizontal position of the locking chambers 92 imbedded in the post 40, with a dally device 43 positioned thereabout.

Figure 10:
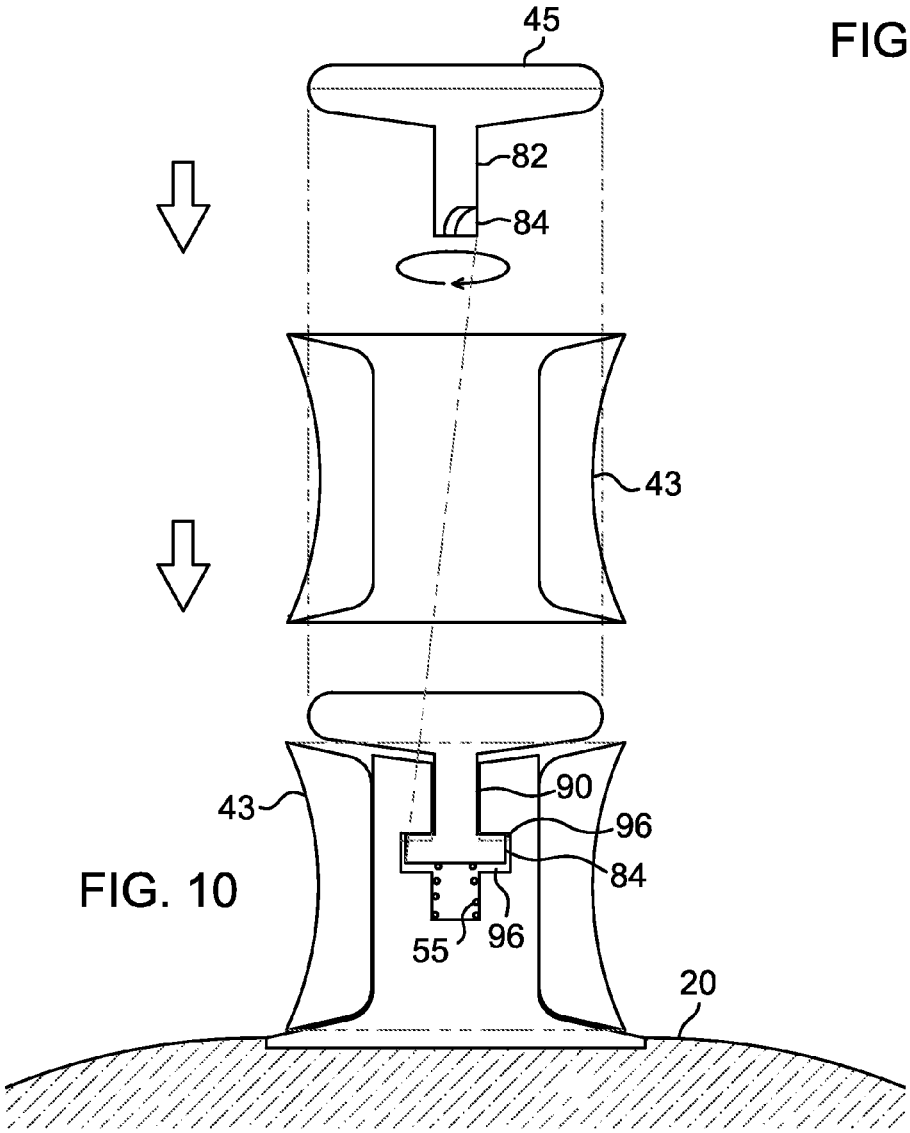
FIG. 10 is a side view cross section of the elements of FIG. 8 assembled together showing the internal mechanics of a key and keyway locking system.

Referring now to FIG. 10, there is shown a cross-section of the cap 45 and post 40 of FIGS. 8 AND 9 assembled on a saddle swell 20, where the bits 84 of the key 82 are positioned in the keyhole 92, the cap 45 is rotated such that the bits 84 are aligned with the locking chamber 96, the spring 55 at the bottom of the insertion chamber forces the bits up into the locking chamber 96 keeping the cap and thus the dally device 43 secured.

Although preferred embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

The invention claimed is:

1. A saddle horn assembly comprising a post assembly, a detachable cap assembly, and a dally traction device;

said post assembly comprising a base for attachment to a saddle, a post extending perpendicular from the base and having a geometric configuration of no more than four sides with the relative angle between adjacent sides no greater than 90 degrees, and having a receiving chamber suited for a quick release locking element; said detachable cap assembly comprising a cap and a quick release locking element including a push button, said locking element being affixed to said cap or constructed as part of said cap; and said dally traction device comprising a void having internal sides with internal angles of no greater than 90 degrees, said internal void being of greater size than said post, said traction device being symmetrical in the horizontal and vertical planes, and being of height equivalent to or less than the height of said post, such that said traction device inserted over said post and secured about said post by said cap assembly.

2. The invention of claim 1 where said push button comprises a spring loaded pin and ball locking element, and said receiving chamber of said post contains a groove or hole in which the ball of said locking element is situated to lock the cap into place.

3. The invention of claim 1 where said locking element consists of any manually activated element that allows for removal and secure reattachment of the cap to the post without tools.

4. The invention of claim 1 where said daily traction device has a hyperboloid shaped exterior.

* * * * *